United States Patent [19]

Humphrey

[11] 3,994,528

[45] Nov. 30, 1976

[54] SELF CLEANING CHAIR FOR BARBER SHOPS AND BEAUTY SHOPS

[75] Inventor: Charlotte Humphrey, Huntington, N.Y.

[73] Assignee: Lawrence Peska Associates, Inc., New York, N.Y. ; a part interest

[22] Filed: Mar. 27, 1975

[21] Appl. No.: 562,472

[52] U.S. Cl. ..... 297/182; 15/301

[51] Int. Cl.[2] ..... A47D 1/11

[58] Field of Search ..... 297/182, 217, 180; 15/301; 248/346

[56] References Cited

UNITED STATES PATENTS

| | | | |
|---|---|---|---|
| 1,635,613 | 7/1927 | Ellerhorst | 297/217 |
| 2,590,673 | 3/1952 | Bezanson | 297/182 |
| 2,782,834 | 2/1957 | Vigo | 297/180 |
| 2,885,714 | 5/1959 | Johnson | 297/217 |

*Primary Examiner*—Roy D. Frazier
*Assistant Examiner*—Darrell Marquette
*Attorney, Agent, or Firm*—Jack D. Slobod

[57] ABSTRACT

A barber and beauty salon chair which is of the usual appearance with a hydraulic or other lift to regulate the height of the patron, but which is self cleaning, as it contains a vacuum suction pump in the base with suction pipes opening onto the floor for suctioning in hair cuttings, and other debris. There is a switch on the chair for turning the suction pump on when the patron is finished, and this causes all the hair cuttings and the like to be suctioned off the floor and into a receptacle inside the base to be emptied out later.

2 Claims, 3 Drawing Figures

SELF CLEANING CHAIR FOR BARBER SHOPS AND BEAUTY SHOPS

This invention relates to self-cleaning chairs for barber shops and beauty salons.

An object of the invention is to provide a novel and improved chair for use in barber shops and beauty salons, which has means for automatically cleaning up cut hair, tissues and other debris from the floor.

Another object of the invention is to provide a novel and improved barber shop and beauty salon chair, in which the base portion of the chair includes vacuum suction means with suction tubes or pipes radiating from a vacuum pump inside the base of the chair, and including a switch for turning the vacuum suction on and off, to pick up any cut hair, and other debris which would fall on the floor.

A further object of the invention is to provide a novel and improved barber and beauty salon chair in which the usual hydraulic base for elevating and lowering the chair, can easily and at low cost be modified to apply a vacuum suction emanating from the entire circumference of the chair, so that when the beauty salon operator or barber is finished, he or she need only push a button to completely clean off the floor immediately.

Still another object of the invention is to provide a novel and improved chair of the type described, which has very much the same appearance of the ordinary chairs now in use, with the added feature of a strong vacuum radiating from a pump inside the base, and drawing all cut hair, tissues, and the like inside the base to a removable receptacle which can be emptied out later as needed.

The above and other objects and advantages of the invention will become apparent from the following description of a preferred embodiment thereof, as illustrated in the accompanying drawings, forming a part hereof.

Figure 1:
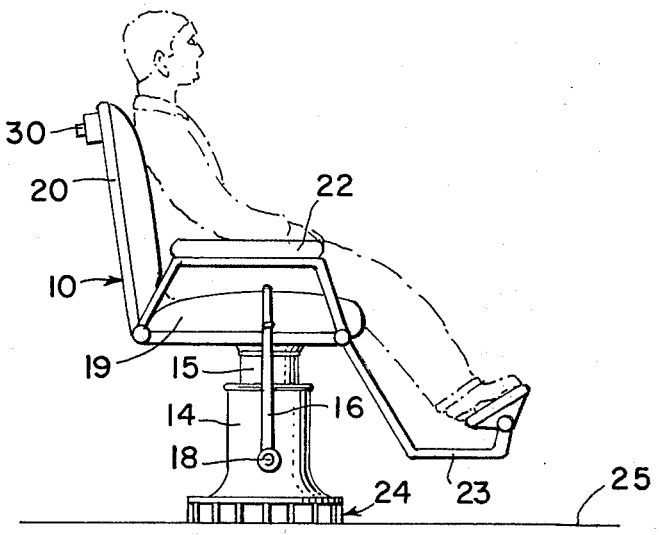
FIG. 1 is a side elevational view of a customer sitting in the improved chair according to the invention.
Figure 2:
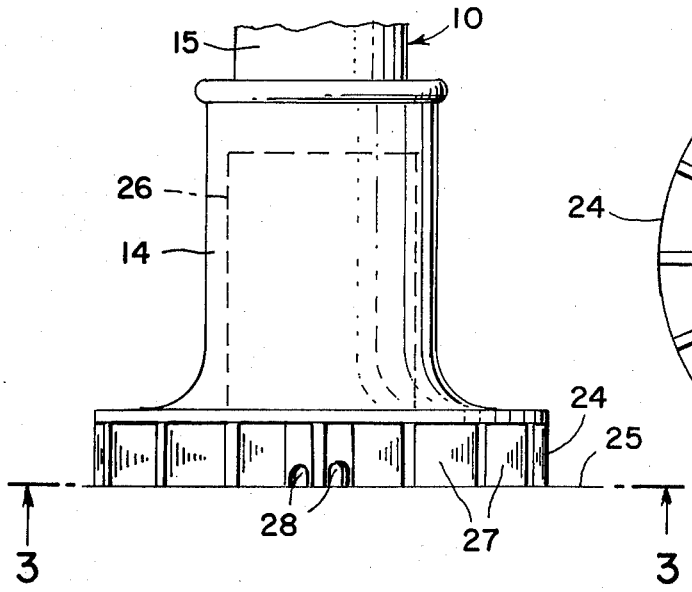
FIG. 2 is a fragmentary elevational view on a larger scale, of the base portion of the chair of FIG. 1.
Figure 3:
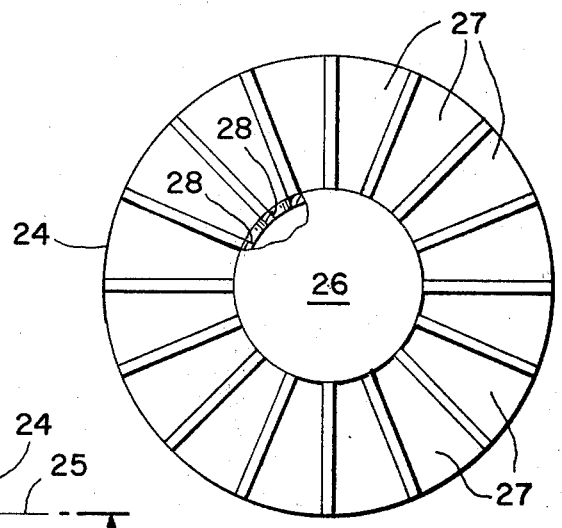
FIG. 3 is a sectional plan view taken substantially on Plane 3—3 of FIG. 2 and showing the vacuum tubes.

In connection with the operation of barber shops and beauty parlors, a major problem is cleaning up the floor around the barber chair of hair cuttings, tissues, and other debris which falls onto the floor during the hair cutting and other operations. To sweep it up is very necessary, and must be done all day long after each customer is taken care of. However, the sweeping by broom, is not very satisfactory, and may result in much of the dust, hair cuttings and the like being swept into the air, and thus to bother other waiting patrons.

The present invention seeks to solve this problem by installing in the heavy base of the barber chair, a vacuum cleaning pump with radiating suction pipes extending therefrom near the floor level. When the patron is finished, the barber or beauty operator merely pushes a button on the chair, and all the debris is suctioned inside the base where it can be removed later in a receptacle.

In order to understand clearly the nature of the invention, and the best means for carrying it out, reference may be had to the drawings, in which like numerals denote similar parts throughout the several views.

As shown, there is a barber chair 10, with a hydraulic cylinder in its base 14, with a piston 15 which is raised or lowered by the handle or lever 16 which engages a shaft 18 extending inside the base to operate the piston for adjusting the height of the customer for the convenience of the barber. The chair has its usual seat portion 19, with tiltable back rest 20, and arm rests 22, coupled with the foot rest 23, so that the chair back rest can be tilted all the way back to place the customer in a reclining position, for a shave or facial massage.

A chair has a lower stable base 24 which rests on the floor 25, and inside the lower base is placed a vacuum cleaning motor driven pump 26 of any usual vacuum pump type, and it has suction tubes or intake ports 27 radiating from the pump 26 and opening upon holes 28 in the perimeter of the base and close to the floor. Thus all the barber has to do when he is finished with the customer, is to push an On-Off switch button 30 mounted on the chair back rest, to turn on the vacuum suction pump, which then immediately suctions all the cut hair and other debris off the floor and inside the base where it enters a receptacle and can be cleaned out from time to time.

While the push button is shown mounted on the chair back, it may also be mounted directly on the lower base so the barber can merely step on it to turn the suction on or off.

Although the invention has been described in specific terms, it is understood that various changes may be made in size, shape, materials and arrangement without departing from the spirit and scope of the invention as claimed.

Having thus described the invention, what is claimed as new is:

1. In a chair for use in beauty salons and barber shops, said chair being supported on a generally cylindrical base adapted to rest on a floor, said base carrying means for raising and lowering said chair, the improvement for cleaning hair cuttings and other debris from said floor comprising: plural radially directed angularly spaced apart suction intake ports formed in the bottom of said base at floor level, and suction producing means located centrally within said base in operative communication with said plurality of ports.

2. The improvement of claim 1 wherein said intake ports are angularly spaced apart uniformly about the periphery of said base.

* * * * *